United States Patent [19]

Roche

[11] Patent Number: 4,629,437

[45] Date of Patent: Dec. 16, 1986

[54] RAPID-START FLUORESCENT LAMP INTEGRATED CIRCUIT BREAKER STRUCTURE AND MANUFACTURE

[75] Inventor: William J. Roche, Essex, Mass.

[73] Assignee: GTE Products Corporation, Stamford, Conn.

[21] Appl. No.: 717,192

[22] Filed: Mar. 28, 1985

[51] Int. Cl.[4] ..... H01J 9/12

[52] U.S. Cl. ..... 445/26; 445/6; 445/20

[58] Field of Search ..... 445/6, 17, 18, 20, 26, 445/40

[56] References Cited

U.S. PATENT DOCUMENTS

| | | | |
|---|---|---|---|
| 3,171,061 | 2/1965 | Simon | 315/107 |
| 3,631,317 | 12/1971 | Miyajima | 315/107 |
| 3,749,467 | 7/1973 | Emidy | 445/26 |
| 3,817,591 | 6/1974 | Deiss | 445/6 |
| 3,968,396 | 7/1976 | Clune | 445/6 |
| 4,005,338 | 1/1977 | Rios | 315/107 |
| 4,114,968 | 9/1978 | Latassa | 445/6 |

FOREIGN PATENT DOCUMENTS

| | | | |
|---|---|---|---|
| 3401192 | 8/1984 | Fed. Rep. of Germany | 445/26 |

*Primary Examiner*—Nicholas P. Godici
*Assistant Examiner*—K. Rowan
*Attorney, Agent, or Firm*—Thomas H. Buffton; Carlo S. Bessone

[57] ABSTRACT

A rapid-start fluorescent lamp has a tubular envelope with a phosphor-coated inner wall surface, a pair of spaced electrodes and a pair of electrical leads sealed into each end of the envelope with one electrical lead connected directly to the electrode and the other electrical lead having an integral circuit breaker connected to the electrode and formed to disconnect the electrode from an energy source during lamp operation. Also, the rapid-start fluorescent lamp is fabricated by preparing a phosphor coated envelope, forming a pair of end members having a pair of leads and an integral circuit breaker with one lead connected directly to the electrode and the circuit breaker connecting the other lead to the electrode, sealing the end members into the envelope, heating and exhaust tubes the envelope, heating the electrodes via the circuit breaker, dispensing a fill gas and mercury into the envelope and pinching off the exhausting of the envelope.

4 Claims, 3 Drawing Figures

RAPID-START FLUORESCENT LAMP INTEGRATED CIRCUIT BREAKER STRUCTURE AND MANUFACTURE

TECHNICAL FIELD

This invention relates to rapid-start fluorescent lamps and more particularly to rapid-start fluorescent lamp structures and manufacture wherein a bi-metal type circuit breaker is an integral part of the lamp configuration.

BACKGROUND ART

In the fluorescent lamp art, both preheat type lamps and rapid-start type lamps are commonly encountered. In the preheat type of discharge lamp, heater current flows through the electrodes only during lamp ignition. Thereafter, it is a common practice to provide an external voltage sensitive starter which opens the heater current circuit discontinuing heater current flow. In contrast, a rapid-start type fluorescent lamp normally has a constant heater current flow through each electrode both during ignition and during operation of the lamp. Unfortunately, heater current flow during operation of a rapid-start fluorescent lamp is lost power which obviously reduces efficiency of the discharge lamp.

Numerous suggestions have been made for enhancing the efficiency of rapid-start fluorescent lamps. For example, U.S. Pat. Nos. 4,052,687; 4,097,779; 4,114,968; 4,156,831 and 4,171,519, all assigned to the Assignee of the present Application, suggest numerous configurations for enhanced operation of rapid-start fluorescent lamps. Generally, each provides a thermally responsive circuit breaker suitable for use in discontinuing heater current when the fluorescent lamp becomes operational.

Although each of the above-listed structures and techniques provides discharge lamps having numerous advantages over prior known configurations and processes, it has been found that problems remain. More specifically, it has been found that a configuration wherein a separate capsule containing a circuit breaker arrangement, which is attached to the inner leads of a fluorescent lamp, does present problems. For instance, attaching a separate capsule containing a circuit breaker requires a cut-out of the inner lead of the discharge device. However, severing the inner lead to facilitate this addition tends to undesirably weaken the support structure for the attached electrode which is obviously an undesirable result. Also, a separate apparatus is required to fabricate a separate capsule and a separate feed system must be utilized to add the capsule to the lamp fabrication operation.

OBJECTS AND SUMMARY OF THE INVENTION

One object of the present invention is to provide an improved rapid-start fluorescent lamp. Another object of the invention is to increase the efficiency of a rapid-start fluorescent lamp. Still another object of the invention is to provide an improved process for manufacturing rapid-start fluorescent lamps. A further object of the invention is to provide an integral circuit breaker and rapid-start fluorescent lamp.

These and other objects, advantages and capabilities are achieved in one aspect of the invention by a rapid-start fluorescent lamp having an elongated tubular envelope with a phosphor-coated inner surface, a pair of spaced electrodes therein, and a pair of electrical leads sealed into and passing through each end of the elongated envelope with one lead directly connected to the electrode and the other lead having a circuit breaker formed therein and connected to the electrode wherein the circuit breaker includes a bimetal strip extending between a pair of upstanding leg members.

In another aspect of the invention, a process for fabricating a rapid-start fluorescent lamp includes the steps of preparing a tubular glass envelope with a phosphor-coated inner surface, forming end members with a pair of electrical leads sealed therein and passing therethrough, an electrode directly connected to one of the electrical leads and a circuit breaker integral to the other lead and connected to the electrode, sealing the end members into the envelope, heating the envelope, exhausting the envelope, heating the electrodes, dispensing a fill gas and mercury into the envelope and pinching off the exhaust tubes of the envelope.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
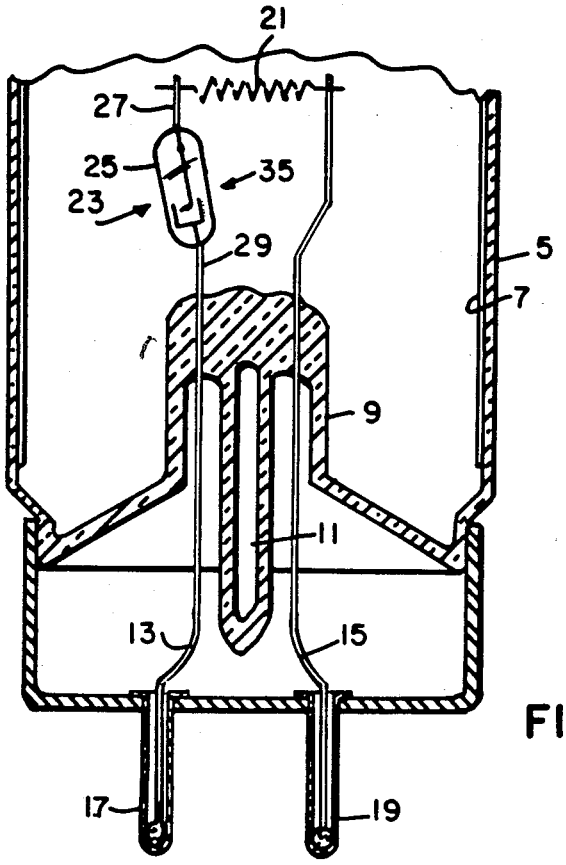
FIG. 1 is a elevational view, partially in section, of one end of a rapid-start fluorescent lamp having an integral circuit breaker array.
Figure 2:
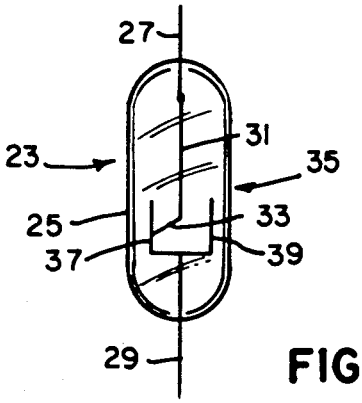
FIG. 2 is an enlarged view of the circuit breaker of FIG. 1.
Figure 3:
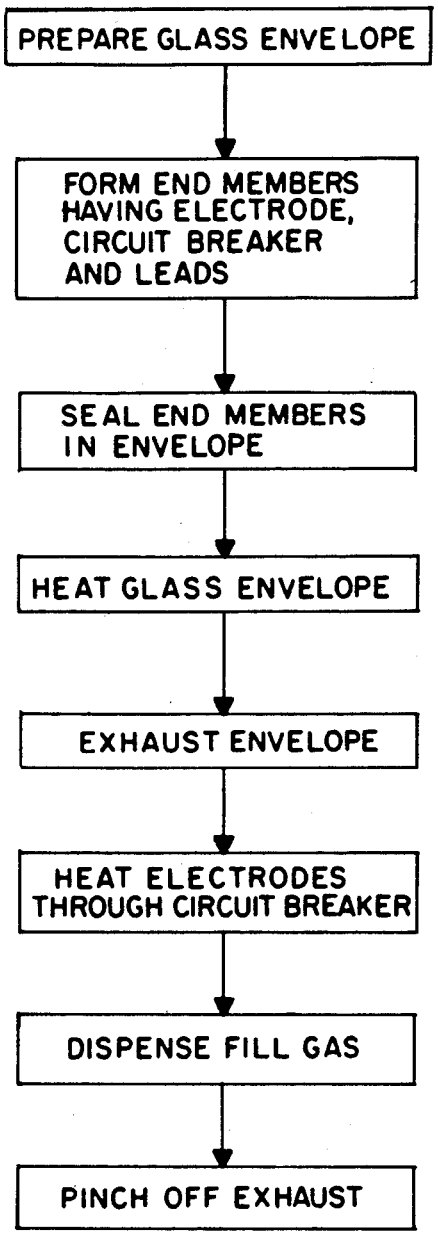
FIG. 3 is a flow chart illustrating a process of manufacture for rapid-start fluorescent lamps.

Referring to FIG. 1 of the drawings, a rapid-start fluorescent lamp includes an elongated tubular glass envelope 5 having an inner wall surface with a phosphor coating 7 thereon. An end member 9 is sealed into each end of the envelope 5 and includes an exhaust tube portion 11 and a pair of electrical conductors 13 and 15 sealed therein and passing therethrough. The electrical conductors 13 and 15 are connected to external pins 17 and 19 suitable for attachment to an energizing source.

Within the glass envelope 5 is a fill gas selected from the group consisting of argon, krypton, neon, helium, xenon and combinations thereof with mercury. An electrode 21 is disposed within the envelope 5 and has one end thereof directly connected to conductor 15 of the pair of electrical conductor 13 and 15. The electrode 21 extends in a direction substantially normal to the longitudinal axis of the envelope 5 with the other end thereof connected to the other conductor 13 of the pair of electrical conductors 13 and 15 by way of an integral circuit breaker 23.

The circuit breaker 23 includes a glass bulb 25, in this example, having first and second leads 27 and 29 respectively sealed therein and passing therethrough. The first lead 27 connects the circuit breaker 23 to the electrode 21 and a bi-metal strip 31. The bimetal strip 31 has an angular portion 33, formed at an angle of about 45° to the longitudinal axis of the bi-metal strip 31 which serves to provide a desired edge contact capability. The second lead 29, which is actually an extension of the electrical conductor 13, is formed to provide a substantially U-shaped configuration 35 having first and second upstanding leg members, 37 and 39 respectively. For reasons to be explained hereinafter, the bi-metal strip 31 is positioned intermediate the first and second upstanding leg members 37 and 39 for a given range of temperatures, contacts the first upstanding leg member 37 for temperatures lower than the given range of temperatures and contacts the second upstanding leg member 39 for temperatures higher than the given range of temperatures.

As to manufacture of the above-described rapid-start fluorescent lamp, an elongated tubular glass envelope with a phosphor-coated inner wall surface is prepared. Also, a pair of end members for the envelope are formed and include a pair of electrical conductors sealed into and passing therethrough, a circuit breaker integral to one of the electrical conductors within the envelope and an electrode connected directly to one of the electrical conductors and to the circuit breaker integral to the other electrical conductor. An exhaust tube extends outwardly from each of the end members.

The end members are sealed into opposite ends of the elongated envelope and the envelope is externally heated and then exhausted by way of the exhaust tubes. In this manner, heat is developed in an amount sufficient to cause the bi-metal strip to leave the first upstanding leg member and advance into contact with the second upstanding leg member whereupon energy is supplied to heat the electrode by way of the circuit breaker and electrical leads electrode in an amount sufficient to process the electrode. Preferably, the glass bulb is also externally heated in an amount sufficient to raise the glass bulb temperature above the above-mentioned given range of temperatures to effect processing of the electrodes. Following, a fill gas and mercury are dispensed into the envelope and the envelope is sealed by pinching off the exhaust tubes. Thus, a rapid-start fluorescent lamp having an operational capability is provided.

As to operation of the above-described rapid-start fluorescent lamp, the bi-metal strip 31 is originally in an inactivated state and in contact with the first upstanding leg member 37 of the circuit breaker 23. Upon application of energy from an external source (not shown) to the external pins 17 and 19, current flow through the circuit breaker 23 is effected and the electrode 21 is initially heated. Thereupon, ionization of the discharge lamp takes place causing the bimetal strip 31 of the circuit breaker 23 to reach a temperature in the range of about 120° to 160° C. Thereupon, the bi-metal strip 31 is caused to move to a position intermittent the first and second upstanding leg member 37 and 39 whereupon lamp starting energy to electrode 21 from an external source is disconnected. Thus, the rapid-start fluorescent lamp does not require electrode energy from an external source during operation of the discharge lamp and this interruption of the energy flow is effected by the operation of the circuit breaker 23.

While there has been shown and described what is at present considered the preferred embodiments of the invention it will be obvious to those skilled in the art that various changes and modifications may be made therein without departing from the invention as defined by the appended claims.

I claim:

1. An integrated circuit breaker and rapid-start fluorescent lamp manufacturing process comprising the steps of:

preparing an elongated tubular glass envelope having a phosphor-coated inner wall surface;

forming a pair of end members each having an electrical lead sealed therein and passing therethrough, an electrode directly connected to said electrical lead, an outwardly extending exhaust tube, and an integral circuit breaker, said circuit breaker having a first lead directly connecting said electrode, a second lead sealed in said end member and passing therethrough with one of said circuit breaker leads having an end formed to provide a pair of spaced upstanding members, and a bimetal strip connecting the other of said circuit breaker leads and extending between said upstanding members at a given range of temperatures, contacting one of said upstanding members at temperatures below and contacting the other one of said upstanding members at temperatures above said given range of temperatures;

sealing said end members into opposite ends of said glass envelope;

heating said glass envelope in an amount sufficient to cause said bimetal strip to contact said other one of said upstanding members;

exhausting said glass envelope;

heating said electrodes by way of said circuit breaker and electrical leads;

dispensing a fill gas and mercury within said envelope; and pinching off said exhaust tubes of said envelope to provide a rapid-start fluorescent lamp having a circuit breaker formed for applying energy to an electrode from an external source.

2. The manufacturing process of claim 1 including a glass bulb sealed to said other one of said pair of electrical leads in surrounding relationship to said upstanding members and said bimetal strip of said circuit breaker.

3. The manufacturing process of claim 2 wherein said given range of temperature are bimetal strip temperatures in the range of about 120° to 160° C.

4. The manufacturing process of claim 2 including the step of externally heating said glass bulb in an amount sufficient to raise said glass bulb temperature above said range of temperatures to effect processing of said electrodes.

* * * * *